US008869977B2

(12) United States Patent
Nlkosey

(10) Patent No.: US 8,869,977 B2
(45) Date of Patent: Oct. 28, 2014

(54) APPARATUS FOR SECURING CARDS TO A MOBILE DEVICE

(71) Applicant: Spencer Nlkosey, Los Angeles, CA (US)

(72) Inventor: Spencer Nlkosey, Los Angeles, CA (US)

( * ) Notice: Subject to any disclaimer, the term of this patent is extended or adjusted under 35 U.S.C. 154(b) by 0 days.

(21) Appl. No.: 13/934,085

(22) Filed: Jul. 2, 2013

(65) Prior Publication Data

US 2014/0001060 A1 Jan. 2, 2014

Related U.S. Application Data

(60) Provisional application No. 61/667,394, filed on Jul. 2, 2012.

(51) Int. Cl.

| | |
|---|---|
| ***B65D 85/00*** | (2006.01) |
| ***A45C 1/00*** | (2006.01) |
| *A45C 11/18* | (2006.01) |

(52) U.S. Cl.

CPC ..... *A45C 1/00* (2013.01); *A45C 2011/188* (2013.01); *A45C 11/18* (2013.01)

USPC ..... 206/39.5; 206/320

(58) Field of Classification Search

CPC ..... G06F 1/1628; A45C 2013/025

USPC ..... 206/320, 38, 39, 39.5; 455/575.1, 575.6

See application file for complete search history.

(56) References Cited

U.S. PATENT DOCUMENTS

| | | | | |
|---|---|---|---|---|
| 1,670,343 | A * | 5/1928 | Clemens | 206/39.5 |
| 8,047,364 | B2 * | 11/2011 | Longinotti-Buitoni | 206/320 |
| 8,418,852 | B2 * | 4/2013 | Ziemba | 206/235 |
| 2001/0035444 | A1 * | 11/2001 | Alis | 224/250 |
| 2012/0055822 | A1 * | 3/2012 | Bullock | 206/320 |

* cited by examiner

*Primary Examiner* — David Fidei

(74) *Attorney, Agent, or Firm* — Cotman IP Law Group, PLC

(57) ABSTRACT

A device for securing credit cards, ID cards, etc is provided. The device comprises a base element configured to be coupled to a smart phone. The base element includes an adhesive backing for removeably coupling the device the smart phone. A pocket panel is attached to the base element with a flexible fabric such as suede, leather or other textile or non-textile material to form a repository or pocket into which items can be inserted. A thumb hole is provided to provide access for slidably removing cards placed in the pocket. The pocket may optionally include a spacer element to define a cavity large enough for multiple cards. The pocket may optionally also include a pressure element to secure the cards in the pocket.

9 Claims, 11 Drawing Sheets

APPARATUS FOR SECURING CARDS TO A MOBILE DEVICE

CROSS-REFERENCE TO RELATED APPLICATIONS

The present application claims the benefit of U.S. Provisional Application Ser. No. 61/667,394, filed on Jul. 2, 2012, the specification of which is herein incorporated by reference for completeness of disclosure.

BACKGROUND OF THE INVENTION

Field of the Invention

Embodiments of the invention described herein pertain to the field of wallets or other such devices for holding a person's personal effects such as their credit cards and personal identification. More particularly, but not by way of limitation, one or more embodiments of the invention enable an apparatus for securing cards and other flat objects such as a drivers license or credit card to a mobile device such a cellular telephone.

BRIEF SUMMARY OF THE INVENTION

One or more embodiments of the invention are directed to an apparatus for securing flat objects such as cards, business cards, credit cards, personal identification, driver's license, and other such flat items to a smart phone.

The apparatus comprises a base element configured to encase or optionally adhere to a smart phone. In the case where the base element adheres to the smart phone an adhesive backing is applied to permit the base to removeably attach to the back of the smart phone. A pocket panel is attached to the base element with a flexible fabric such as suede, leather or other textile or non-textile material to form a repository or pocket into which items can be inserted. The amount of flexible fabric utilized enables the pocket to expand as needed and permit a varying number of items to be inserted into the pocket. Although one or more embodiments of the invention make use of a flexible fabric to attach the pocket to the base element alternative embodiments may make use of non-flexible materials that fix the dimensions of the pocket to a predetermined size. The flexible fabric may, for example, be the same material as the base element.

The pocket can vary in size depending upon the number of cards and other items it is intended to hold. The interior cavity of the pocket may optionally contain a convex pressure element adhered to at least one side of the interior cavity so as to apply pressure to flat items inserted into the cavity and thereby prevent the flat items from slipping out of the cavity.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION

An apparatus for securing cards to a mobile device will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. Furthermore, although steps or processes are set forth in an exemplary order to provide an understanding of one or more systems and methods, the exemplary order is not meant to be limiting. One of ordinary skill in the art would recognize that the steps or processes may be performed in a different order, and that one or more steps or processes may be performed simultaneously or in multiple process flows without departing from the spirit or the scope of the invention. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the invention.

The process of manufacturing the device of the present invention will now be described with respect to FIGS. 1 to 7.

Figure 1:
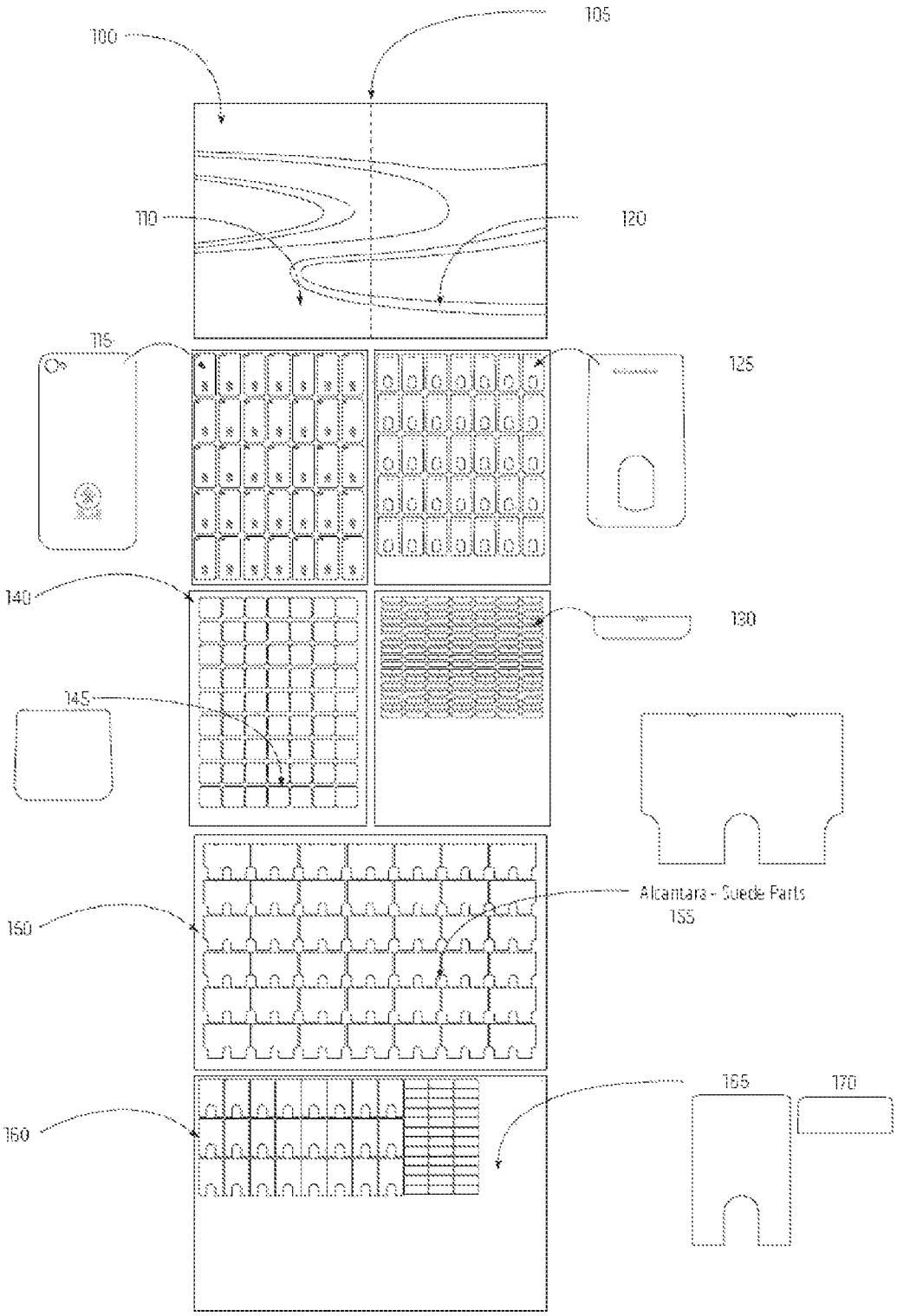
FIG. 1 illustrates the elements utilized and step for manufacturing the apparatus for securing cards to a mobile device in accordance with one or more embodiments of the present invention.

FIG. 1 illustrates the elements utilized and steps for manufacturing the apparatus for securing cards to a mobile device. To form the apparatus described in this detailed description a wood veneer is utilized to form a base element master (100) that is attached to a mobile device such as a smart phone. The size of base element master (100) can vary depending on what size mobile device the apparatus is to be utilized with. Although a wood veneer is utilized as an example of a base element, any material sufficiently rigid enough to work as a case for an electronic mobile device is suitable to implement one or more embodiments of the invention. The invention is not limited solely to the use of wood veneers. When an attractive wood case is desired, the base element can be made using a wood veneer such as rosewood, macassar, ebony, zebrawood or any other visually pleasing veneer.

In one or more embodiments of the invention, base element master (100) is cut to a manageable size (e.g., 24"×36") so permit better maneuverability during manufacturing. This is not a required step so long as the endpoint which is that a base element master 100 ends up with a base element 115 (See e.g., FIG. 3) that is sized to fit the target electronic mobile device. Base element master 100 is then cut at halfway point 105 thereby bisecting the base element master 100 into two smaller pieces (e.g., 12"×18"). A removable adhesive backing (110) is then applied to the back of base element master 100 using pressure and heat. An iron or other such device is typically utilized to provide the pressure and heat for purposes of fixing the removable adhesive backing to the base element master.

The base element master is then cut into smaller base elements 115 that match the footprint of the mobile device on which the apparatus for securing cards is to be coupled. When the target mobile device is a smart phone such as an iPhone 4/4s or any other smart phone, the base element 115 is sized to match the footprint of the device. The base element 115 is configured to include at least one cutout, e.g. 340 and 342, for items such as a camera (e.g. 340), flash (e.g. 342) or other components of the smart phone. The cutout could be a single one large enough to accommodate both camera and flash, for instance, or one for each accessory. If an ornamental design element is desired the base element is laser cut to add engraving or other ornamentation.

Pocket panel 125 is configured so as to provide a thumb hole cutout 305. Pocket panel 125 may be made of the same material as base panel 115 or other material such as leather, vinyl, etc. The thumb hole, e.g. 305, can be any size but in one embodiment of the invention the thumb hole provides a window in the approximate size of a thumb to provide access through which a user can slide out a card, e.g. a credit card or driver's license, from the pocket. The pocket panel is typically at least the width and length of a credit card but can be other sizes as desired. The pocket panel is backed by the Bemis® film. In at least one embodiment of the invention, glue, e.g. Bemis® Polyurethane Glue Technology, is used to couple base element 115 and pocket panel 125 together to form a pocket.

Element 130 of FIG. 1 shows stacked piece of acrylic and/or wood configured for the thickness of three stacked credit cards. Element 130 may be Bemis® film backed, for instance. Note that spacer element 130, also referred to herein as a sizing element, could be sized to fit any number of cards. For example, it could be sized for one credit card, 5 credit cards, etc. Spacer element 130 is optional and may not be needed in some embodiments. For instance, in an embodiment wherein pocket panel 125 is a flexible material, e.g. leather, spacer element may not be necessary since the material may be configured to provide the needed pocket cavity.

The interior cavity of the pocket may include a pressure element, e.g. 145 (FIG. 5), adhered to at least one side of the interior cavity so as to apply pressure to items inserted into the cavity and thereby prevent them from slipping out of the cavity. Block 140 shows cut squares of the material utilized to create the convex pressure element. In a preferred embodiment, the pressure element is stainless steel. The material is then cut into the shape illustrated as 145 of FIG. 5. In one or more embodiments of the invention shapes 145 are formed by a Wire EDM precision cutting process.

The flexible fabric utilized to join the base element and pocket panel together are depicted at block 150. Block 150 shows 24"×36" sheets of a flexible material, e.g. Alcantara® suede, used in accordance with one embodiment of the invention. Other fabrics are also within the scope and spirit of the invention. Block 155 shows the parts being cutout and block 165 shows the cutouts of the film material, e.g. Bemis® polyurethane film, for coupling all the parts together. Those of skill in the art would appreciate that other methods may be sued to couple the components together, for instance, glue, staples, sewing, etc.

Figure 2:
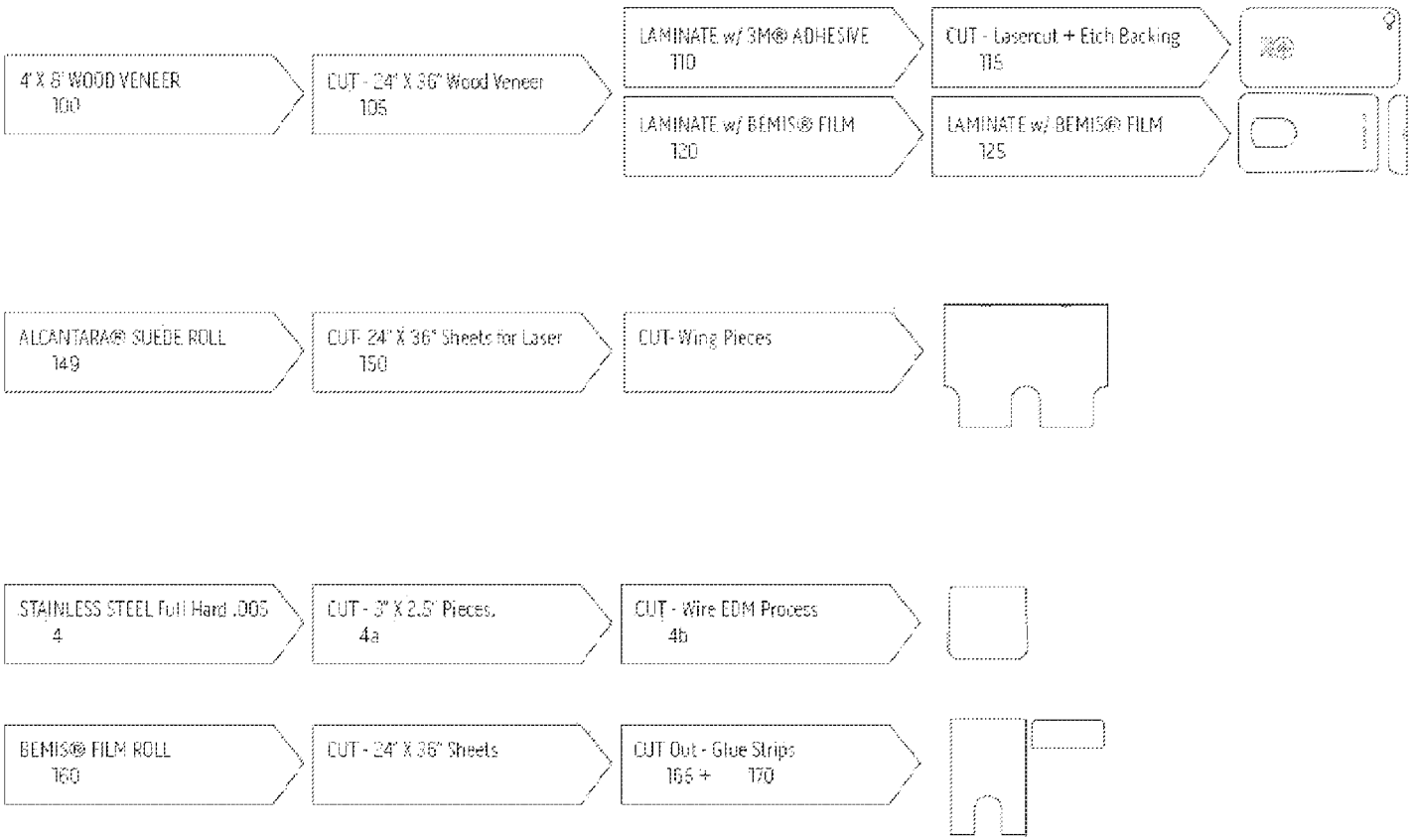
FIG. 2 further illustrates the process for manufacturing the apparatus for securing cards to a mobile device in accordance with one or more embodiments of the present invention.

FIG. 2 further illustrates the process for manufacturing the apparatus for securing cards to a mobile device by showing the sequence and interrelationship of the elements depicted in FIG. 1.

Figure 3:
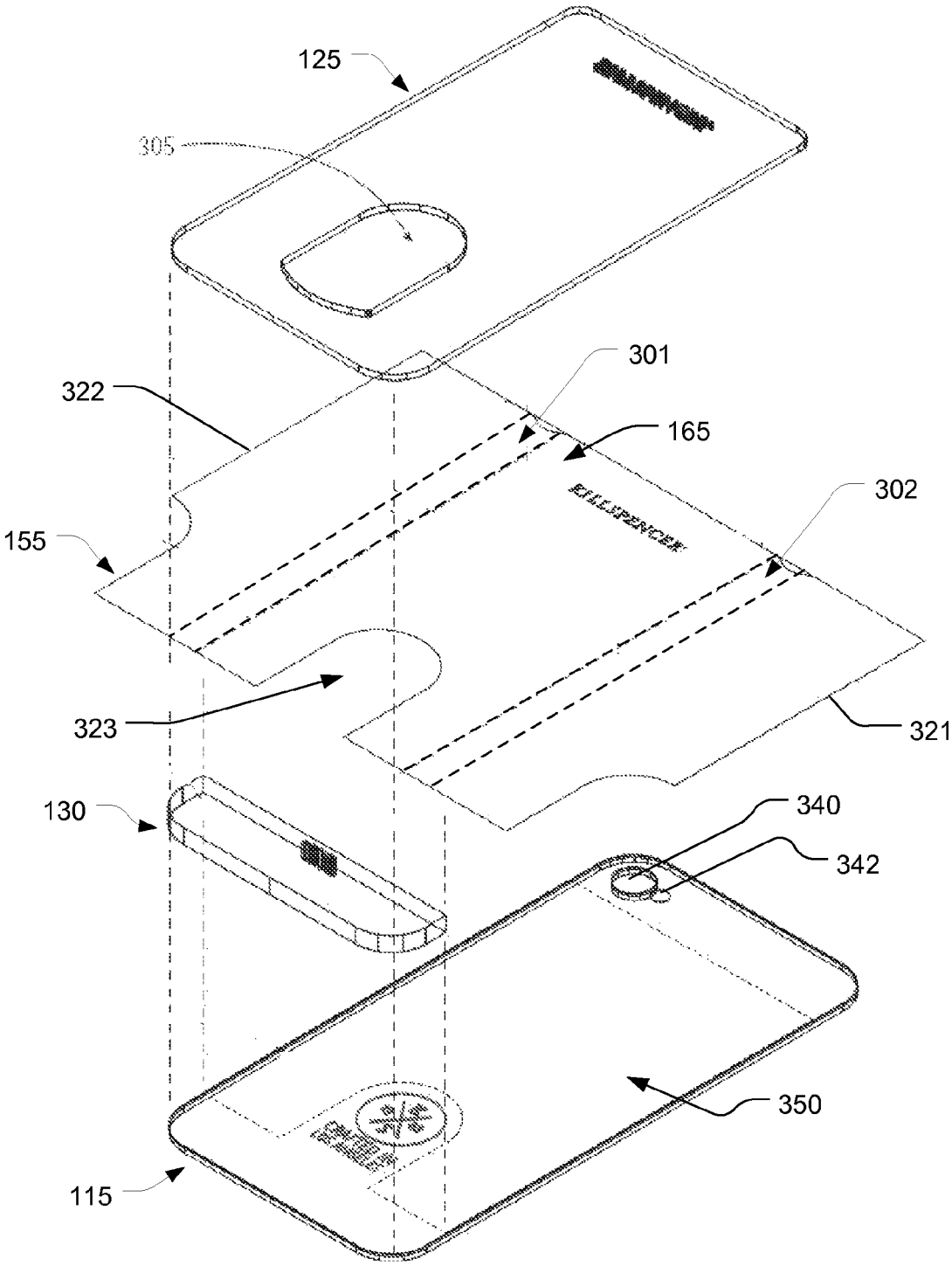
FIG. 3 is an exploded view of the apparatus for securing cards to a mobile device in accordance with one or more embodiments of the present invention.
Figure 6:
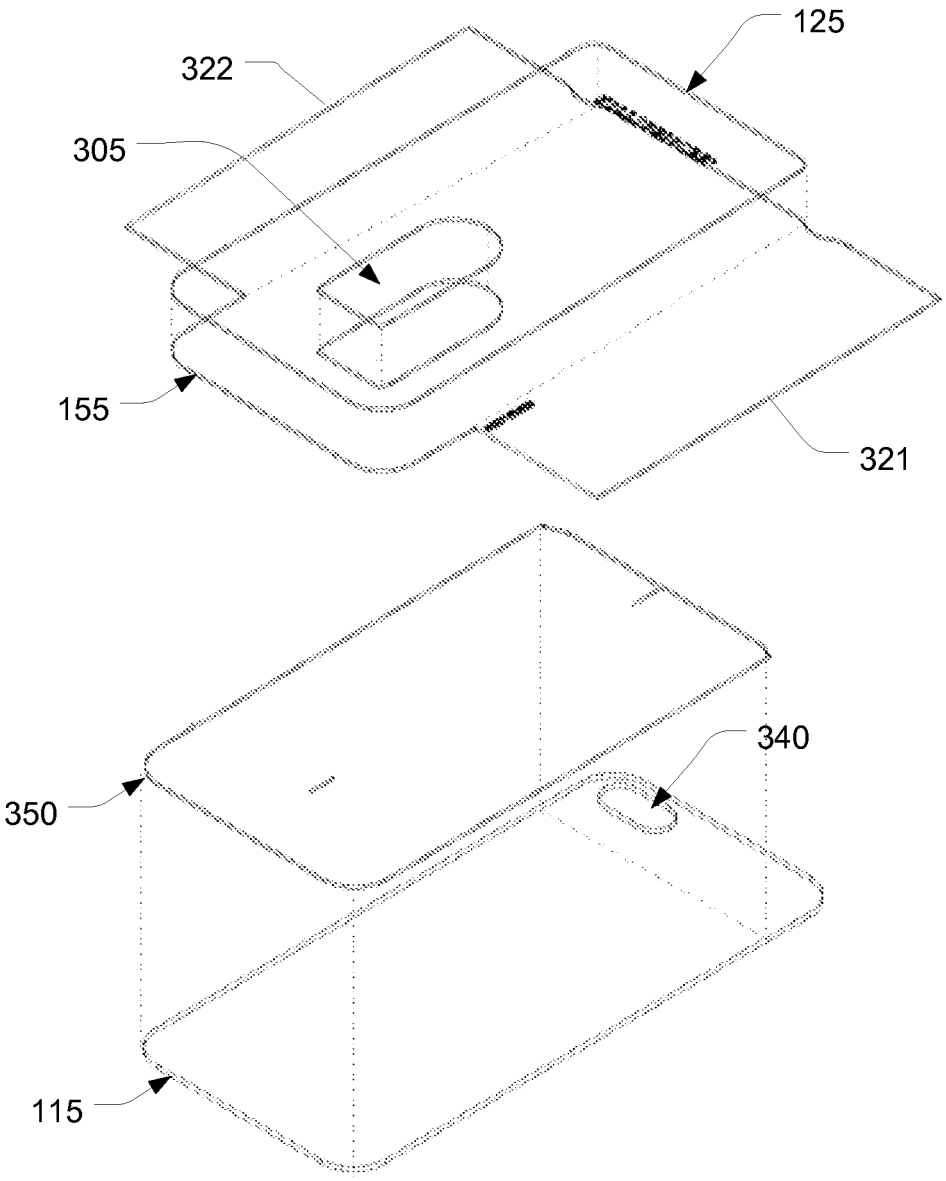
FIG. 6 is an exploded view of the apparatus for securing cards to a mobile device in accordance with embodiments illustrated in FIGS. 5A-C.

FIG. 3 and FIG. 6 are exploded views of different configurations of the apparatus for securing cards to a mobile device in accordance with embodiments of the present invention. Base element 115 is the base element configured to be adhered to the mobile device. Base element 115 contains an adhesive backing (e.g., Bemis® Polyurethane film) that enables base element 115 to be removably coupled to the mobile device such as a smart phone. An optional sizing or spacer element 130 is a sizing piece that may be used to define the inner thickness of the pocket. When used, e.g. embodiment of FIG. 3, sizing element 130 is about the thickness of three credit cards in the example illustrated here but can be modified to accommodate more or less items in the pocket.

In one or more embodiments, sizing element 130 is sandwiched between base element 115 and pocket panel 125. Alternatively sizing element 130 may be machined to be part of base element 115 or pocket panel 125. Flexible fabric 155 may be used to couple base element 115 to pocket panel 125. In one or more embodiments, base element 115 further comprises element 350 configured as film element 165 for coupling the front side of base element 115 to the flexible fabric 155. Also, pocket element 125 further comprises element 165 for coupling the back side of pocket element 125 to the flexible fabric 155. Those of skill in the art would appreciate that element 350 does not have to take the shape of film element 165 and that film element may not be needed so long as the purpose of fixedly securing the flexible fabric element to the base element is achieved. Thus, securing could be accomplished by gluing, sewing, etc.

In at least one embodiment of the invention, fabric 155 is a layer of flexible material, e.g. Alcantara® ultra-suede, configured to be folded around to create a pocket with a top wall, a bottom wall and two side walls 301 and 302. When folded, fabric 155 includes cutout section 323 which is a continuation of the thumb hole 305 (discussed below). In the illustration of FIG. 3, Fabric 155 is configured to fold inwards towards base panel 115 so that when assembled, ends 321 and 322 are abutting thus forming a pocket with spacer element 130 and pressure element 145 (FIG. 5) optionally coupled within and creating a sidewall 301 on one side and 302 on the other side of the pocket. Pocket panel 125 is coupled to the outside of the top wall of the pocket created by fabric 155 and the front of base panel 115 is coupled to the outside of the bottom wall. Those of ordinary skill in the art would recognize that the fabric does not itself have to be shaped into a pocket but may be configured to only act as side walls coupling both base panel 115 and pocket panel 125 thus forming the pocket.

Pressure element 145 is a spring-like element preferably made out of stainless steel and pre-pressed to hold its form. Pressure element 145 is preferably convex in shape. Convex element 145 may be secured to an inside wall in the pocket created by fabric 155.

Pocket panel 125 is configured with thumb hole (or cavity) 305. Thumb hole 305 is shaped to allow the movement of a person's thumb to easily eject one or multiple credit cards or items held within the apparatus. Pocket panel 125 is preferably laminated with the polyurethane film and configured to be coupled with convex pressure element 145.

Once the element depicted in FIG. 3 are assembled flat objects are held in place in the device by the convex pressure element once they are inserted into the pocket created by sandwiching together of the base element and pocket element. Thus the apparatus provides a useful device for holding items such as cards, credit cards, business cards, reward cards, personal identification, driver's license or any other items that are flat and generally shaped about the size of a credit card.

Figure 4A:
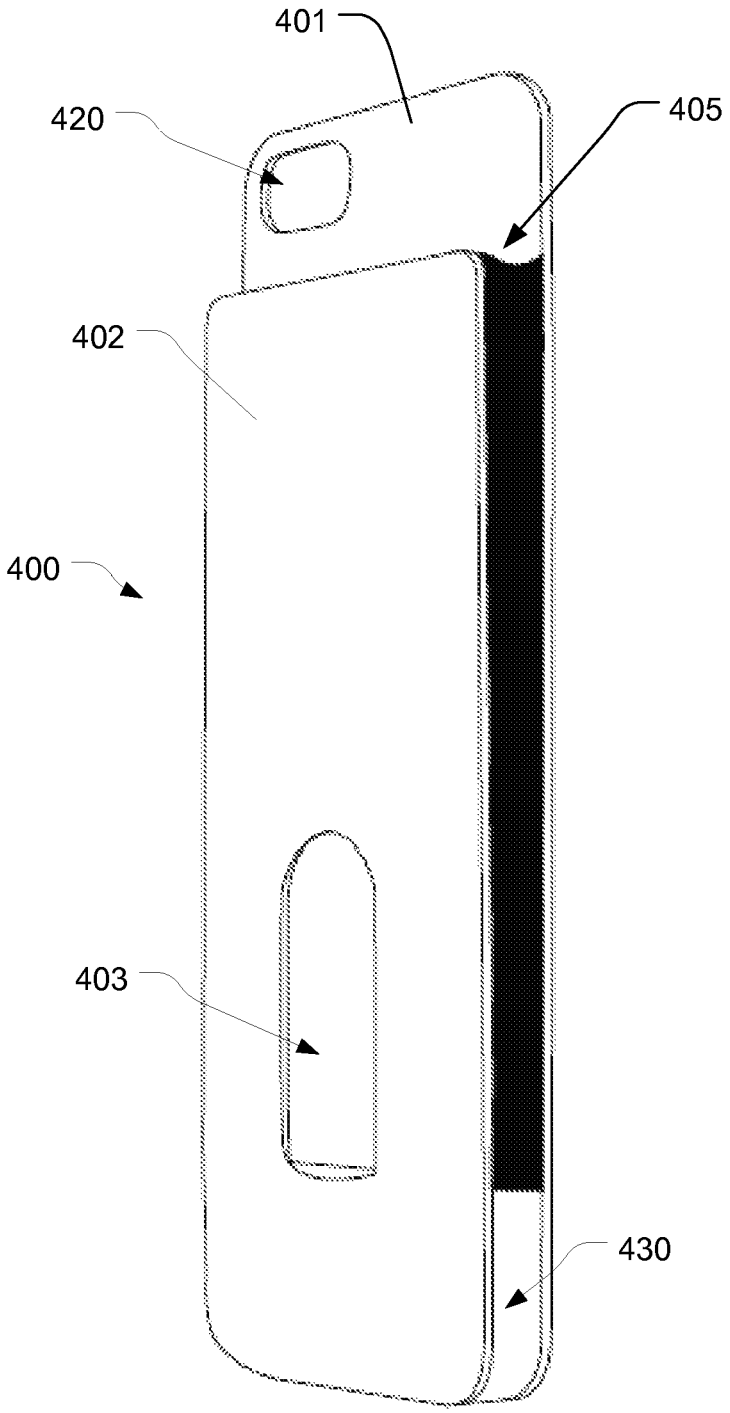
FIGS. 4A-C are illustrations of the apparatus for securing cards in accordance with one or more embodiments of the present invention.
Figure 4B:
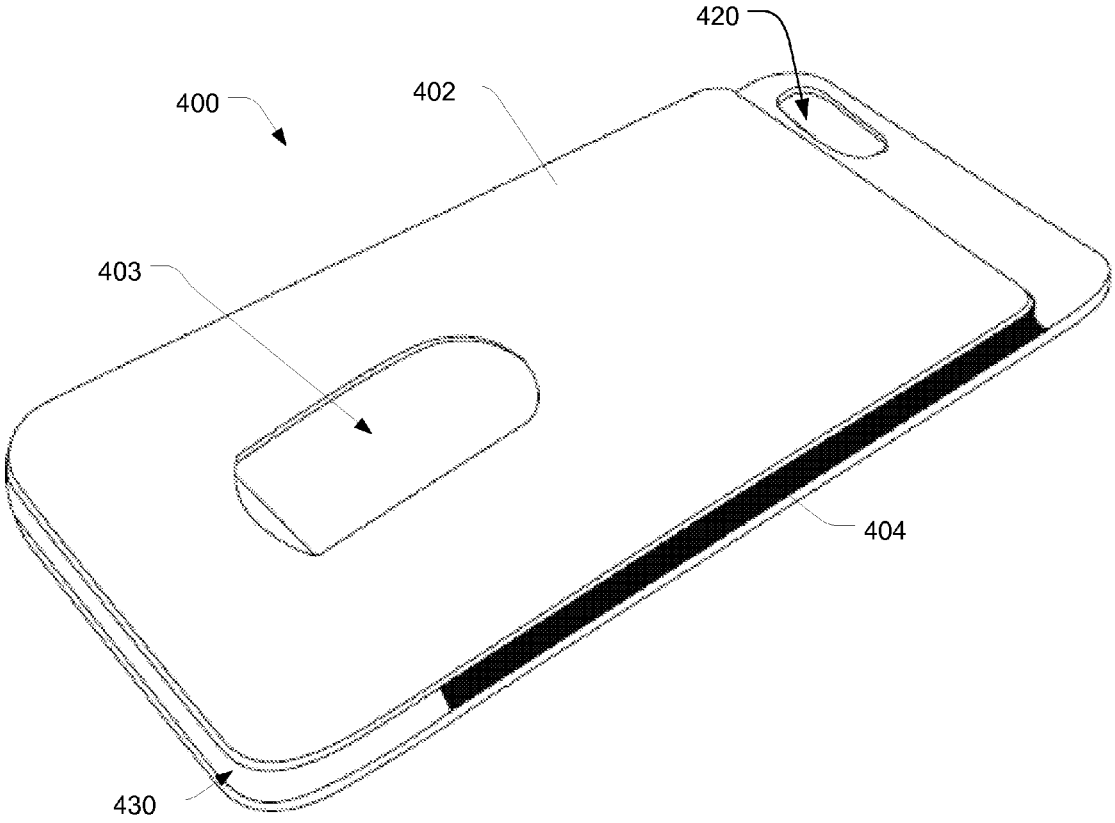
Figure 4C:
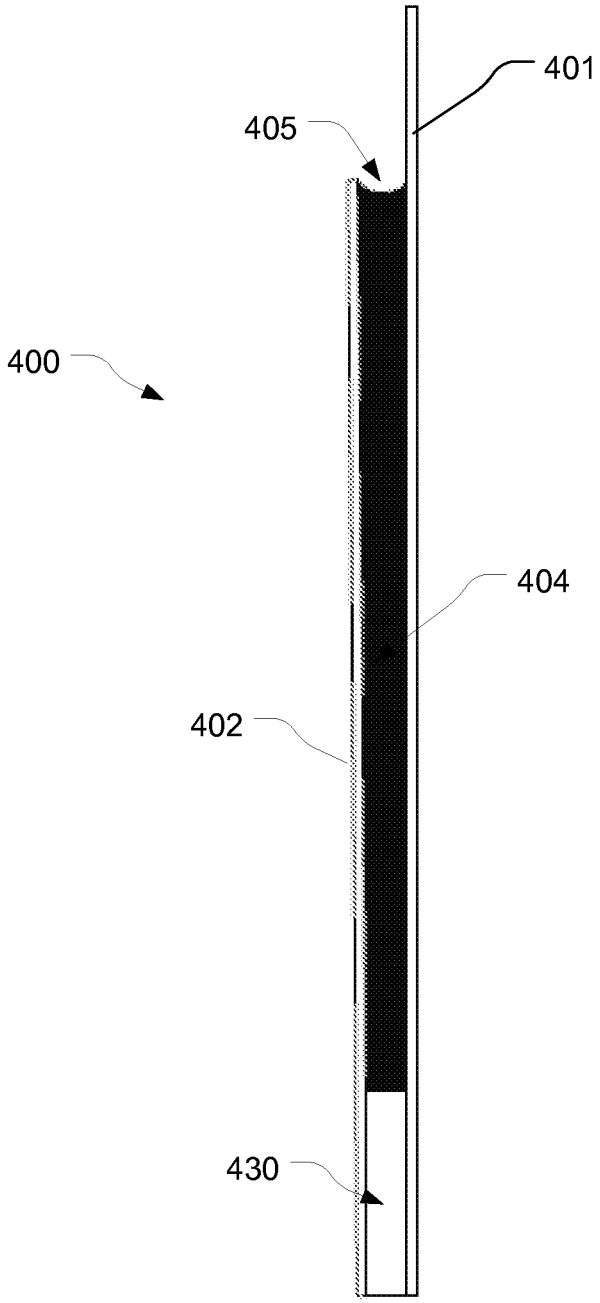

FIGS. 4A-C are illustrations showing different views of the apparatus for securing cards in accordance with one or more embodiments of the present invention. As illustrated device 400 comprises an apparatus in accordance with an embodiment of the present invention configured to be coupled to the back of a smart phone. Element 401 is the base element (e.g. 115 of FIG. 3). Base element 401 is configured to approximate the footprint of the back of the target smart phone device and has a front side and a back side. The back side of the base element 401 is configured to couple to the back of smart phone. Coupling could be accomplished with glue or other types of adhesive, for instance. Base element 401 further includes one or more cutouts (cavities), e.g. 420, for access (or prevent obstruction) to the accessories of the smart phone device, e.g. camera, flash, battery, etc.

Device 400 further includes pocket element 402 coupled to the front side of the base element 401 to form a pocket with opening 405. The base element 401 and pocket element 402 are coupled together with flexible element 404 forming the sides thereof. Pocket element 402 further includes a thumb window 403 which is preferably shaped to allow the movement (e.g. sliding) of a person's thumb or other finger to slide out (or eject) one or multiple credit cards or items held in the pocket. Optional spacer element 430 is included between base element 401 and pocket element 402 thereby sizing the pocket for the desired number of cards. In a preferred embodiment, pocket element 402 is further configured such that accessories of the smart phone are not obstructed.

Figure 5A:
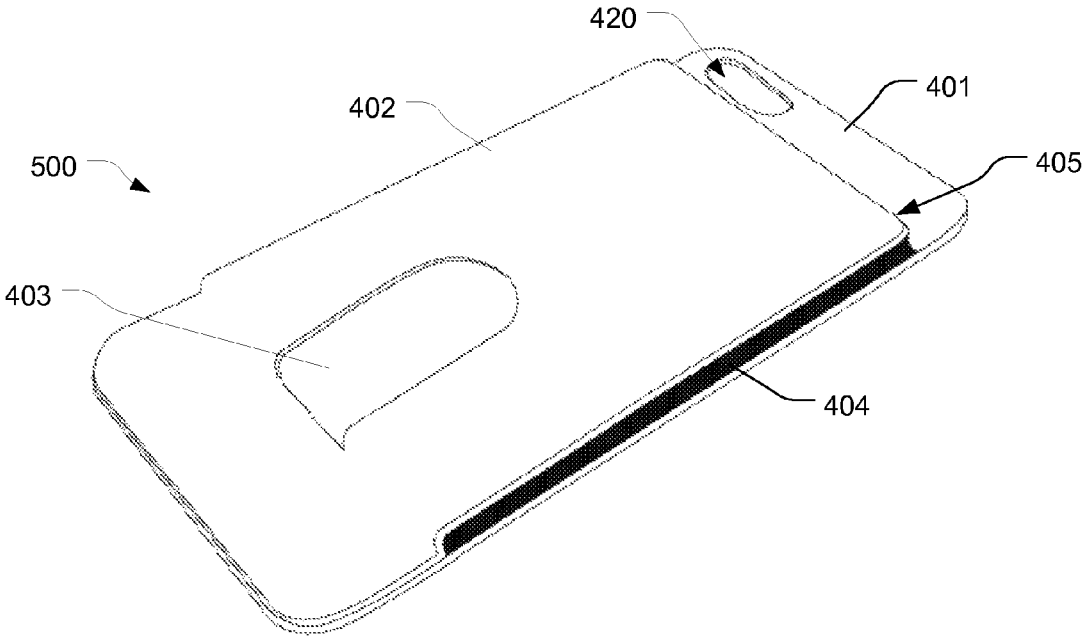
FIGS. 5A-C are illustrations of another configuration of the apparatus for securing cards in accordance with one or more embodiments of the present invention.
Figure 5B:
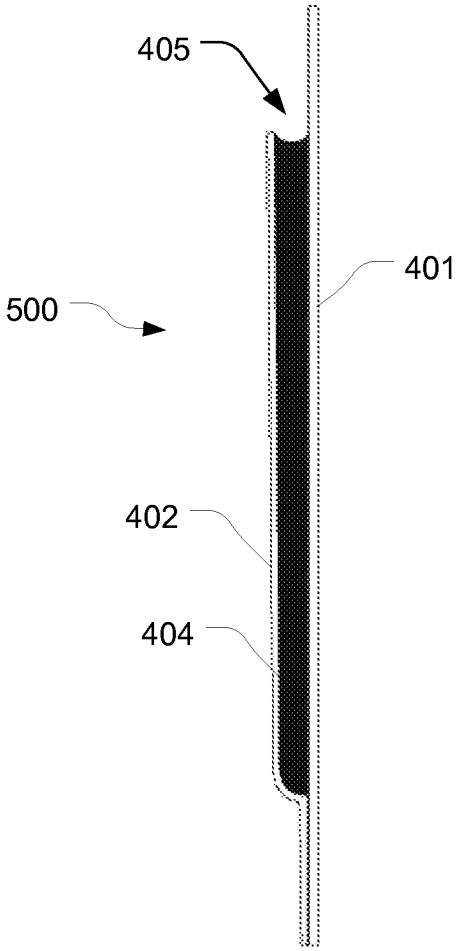
Figure 5C:
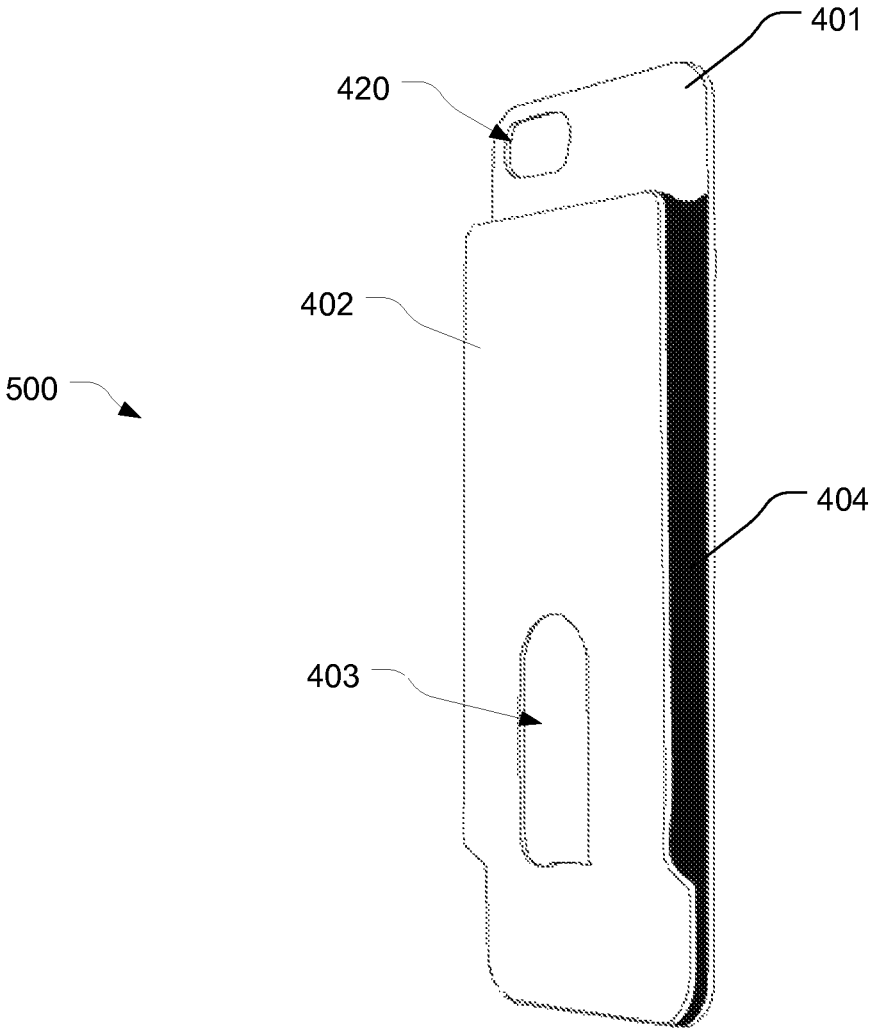

FIGS. 5A-C are illustrations showing different views of a second configuration of the apparatus for securing cards in accordance with one or more embodiments of the present invention. As illustrated device 500 is an illustration of an embodiment of the apparatus of the present invention. Element 401 is the base element (e.g. 115 of FIG. 3). Base element 401 is configured to approximate the footprint of the back of the target smart phone device and has a front side and a back side. The back side of the base element 401 is configured to removably couple to the back of a smart phone or similar device. Coupling could be accomplished with glue or other types of adhesive, for instance. Base element 401 further includes one or more cutouts (cavities), e.g. 420, for access (or to prevent obstruction) to the accessories of the smart phone device, e.g. camera, flash, battery, etc.

Device 500 further includes pocket element 402 coupled to the front side of the base element 401 to form a pocket with opening 405. The base element 401 and pocket element 402 are coupled together with flexible element 404 forming the sides thereof. Pocket element 402 further includes a thumb window 403 which is preferably shaped to allow the movement (e.g. sliding) of a person's thumb or any other finger to slide out (or eject) one or multiple credit cards or items held in the pocket. In a preferred embodiment, pocket element 402 is further configured such that accessories of the smart phone are not obstructed.

Figure 7:
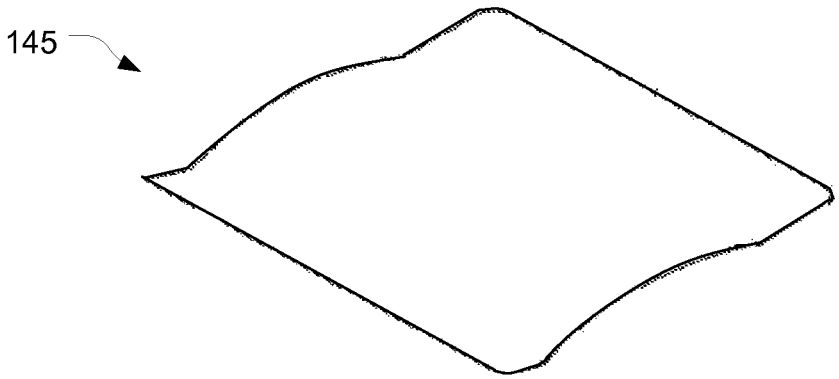
FIG. 7 is an illustration of the pressure element of the apparatus for securing cards to a mobile device in accordance with one or more embodiments of the present invention.

FIG. 7 is an illustration of the optional pressure element of the apparatus for securing cards to a mobile device in accordance with one or more embodiments of the present invention. As illustrated, in a preferred embodiment, the pressure element is convex shaped and made out of stainless steel.

While the invention herein disclosed has been described by means of specific embodiments and applications thereof, numerous modifications and variations could be made thereto by those skilled in the art without departing from the scope of the invention set forth in the claims.

What is claimed is:

1. An apparatus for securing flat object to a mobile device comprising:

a base element configured to fit within a footprint of a mobile device's back panel, said base element having a front side and a back side, wherein said back side comprises an adhesive for coupling said base element to said mobile device's back panel;

a pocket element;

a flexible fabric coupled to said base element and said pocket element to form a side wall of a pocket between said front side of said base element and said pocket element; and a pressure element coupled to at least one inner side of said pocket wherein said pressure element is configured to exert enough pressure to hold a flat object in place when said flat object is inserted into said pocket.

2. An apparatus of claim 1, wherein said pocket element includes a thumb hole that provides access for sliding out flat objects inserted into said pocket.

3. An apparatus of claim 1, wherein said base element includes one or more cutouts for access to accessories of said mobile device.

4. An apparatus of claim 1, wherein said pocket is configured to fit at least one credit card.

5. An apparatus of claim 1, wherein said pressure element is flat and spring like.

6. An apparatus for securing flat object to a mobile device comprising:

a base element configured to fit within a footprint of a mobile device's back panel, said base element having a front side and a back side, wherein said back side comprises an adhesive for coupling said base element to said mobile device's back panel;

a pocket element made of a flexible material; and a flexible fabric coupled to said base element and said pocket element to form a side wall of a pocket between said front side of said base element and said pocket element, wherein said pocket element includes a thumb cavity for ejecting one or more cards from said pocket.

7. An apparatus of claim 6, wherein said pocket element includes a thumb hole that provides access for sliding out flat objects inserted into said pocket.

8. An apparatus of claim 6, wherein said base element includes one or more cutouts for access to accessories of said mobile device.

9. An apparatus of claim 6, wherein said pocket is configured to fit at least one credit card.

* * * * *